US005271333A

United States Patent [19]

Gonsalves

[11] Patent Number: 5,271,333

[45] Date of Patent: Dec. 21, 1993

[54] SWITCHING MECHANISM FOR TROLLEYS

[75] Inventor: George E. Gonsalves, Winter Haven, Fla.

[73] Assignee: Erie Manufacturing, Inc., Bartow, Fla.

[21] Appl. No.: 953,542

[22] Filed: Sep. 29, 1992

[51] Int. Cl.[5] ..... E01B 25/26

[52] U.S. Cl. ..... 104/100

[58] Field of Search ..... 104/96, 100, 130, 131; 246/433

[56] References Cited

U.S. PATENT DOCUMENTS

| | | | |
|---|---|---|---|
| 2,507,853 | 5/1950 | Dahlberg | 104/100 |
| 3,541,965 | 11/1970 | McElroy | 104/130 |
| 3,712,237 | 1/1973 | McElroy | 104/130 X |
| 3,818,836 | 6/1974 | Swilley | 104/100 |
| 3,999,730 | 12/1976 | Gonsalves et al. | 104/130 |
| 4,276,831 | 7/1981 | Leger | 104/100 X |
| 4,279,201 | 7/1981 | Solomon | 104/100 |
| 4,615,273 | 10/1986 | Osthus et al. | 104/130 X |
| 4,646,646 | 3/1987 | Swilley | 104/100 |
| 4,840,123 | 6/1989 | Osthus et al. | 104/100 |

FOREIGN PATENT DOCUMENTS 8706549 11/1987 World Int. Prop. O. ..... 104/100

*Primary Examiner*—Robert J. Oberleitner
*Assistant Examiner*—S. Joseph Morano
*Attorney, Agent, or Firm*—A. W. Fisher, III

[57] ABSTRACT

A switching mechanism for use with an overhead rail system including a main rail track and a branch rail track to support and move product thereon, the switching mechanism comprises a first switching member and a second switching member including a first switching element and a second switching element respectively coupled together by a branch rail positioning means wherein the second switching element is selectively movable between a first and second position such that the product is transported on the main rail track when the second switching element is in the first position and the product is transported from the branch rail track to the main rail track when the second switching element is in the second position.

11 Claims, 4 Drawing Sheets

SWITCHING MECHANISM FOR TROLLEYS

BACKGROUND OF THE INVENTION

1. Field of the Invention

A switching mechanism for use with an overhead rail conveyor system including a main and branch rail track to support and move product thereon.

2. Description of the Prior Art

It is common practice to employ overhead conveyors with garment storage and the like where a number garments may be stored on single rods or hangars to be conveniently transferred by means of wheeled trolleys. The conveyors may consist of horizontal and sometimes inclined tracks over which the trolleys are movable to carry suspended garment along a track which may include a number of branch tracks for delivering the garments to various stations or locations off the main track. The branch tracks dictate the use of switching mechanisms to the trolleys to the various stations or locations.

U.S. Pat. No. 3,999,730 describes a switch rail for a trolley conveyor track system comprising a flexible rail segment joined to a straight rail segment movable between first to second switching positions for connecting a first track section selectively with second and third track sections. The flexible rail segment includes a rigid link for limiting flexure movement thereof.

U.S. Pat. No. 3,712,237 teaches a switch mechanism for monorail type trolley conveyor tracks. The switch takes advantage of a spring-loaded toggle linkage and a pivoted shifter member struck by a trolley for shifting a flexible switching track section into alignment selectively with either of two angularly disposed track sections.

U.S. Pat. No. 3,541,965 shows a semiautomatic switching apparatus for monorail trolley conveyors having the capability of receiving trolleys moving on three angularly spaced paths or tracks. The apparatus includes a spring-loaded toggle linkage for releasably holding a flexible track segment in two angularly adjusted positions together with switching levers having parts in the paths of movement of the trolleys on all tracks of the switching apparatus.

U.S. Pat. No. 4,646,646 describes a switch for controlling the movement of trolleys on overhead tracks comprising a plurality of tracks intersecting with each other wherein switch is adaptable to be inserted between straight and curved tracks.

Additional examples of the prior art are found in U.S. Pat. Nos. 2,507,853, 3,818,836, 4,615,273 and 4,840,123.

SUMMARY OF THE INVENTION

The present invention relates to a switching mechanism for use with an overhead rail system for supporting and transporting products thereon.

The overhead rail system comprises an overhead support to support a main rail track and a branch rail track. The main rail track comprises a substantially horizontal main rail; while, the branch rail track comprises an inclined branch rail and an extension branch rail movable between a first or upper substantially horizontal position and a second or lower inclined position in substantially coaxial alignment with the inclined branch rail.

The switching mechanism is configured to be operatively coupled between the inclined branch rail and extension branch rail to permit selective movement of the extension branch rail between the first or upper position and the second or lower position relative to the inclined branch rail.

The switching mechanism comprises a first switching member affixed to the inclined branch rail and a second switching member affixed to the extension branch rail coupled together by a branch rail positioning means.

The first switching member comprises a first switching element partially disposed within the inclined branch rail and a second switching member comprises a second switching element partially disposed within the extension branch rail.

The branch rail positioning means comprises an interconnecting switch element and a bias means. The interconnecting switch element is affixed to the first switching element and movably coupled to the second switching element. The bias means includes a spring or bias to selectively bias or position the extension branch rail in the first position.

In use, the extension branch rail is normally held in the first position by the bias means. In this configuration, product is moved along the main rail track. To permit feeding or movement of product from the branch rail track to the main rail track, the extension branch rail is moved from the position first to the second position against the face of the bias means.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figures 1, 2:
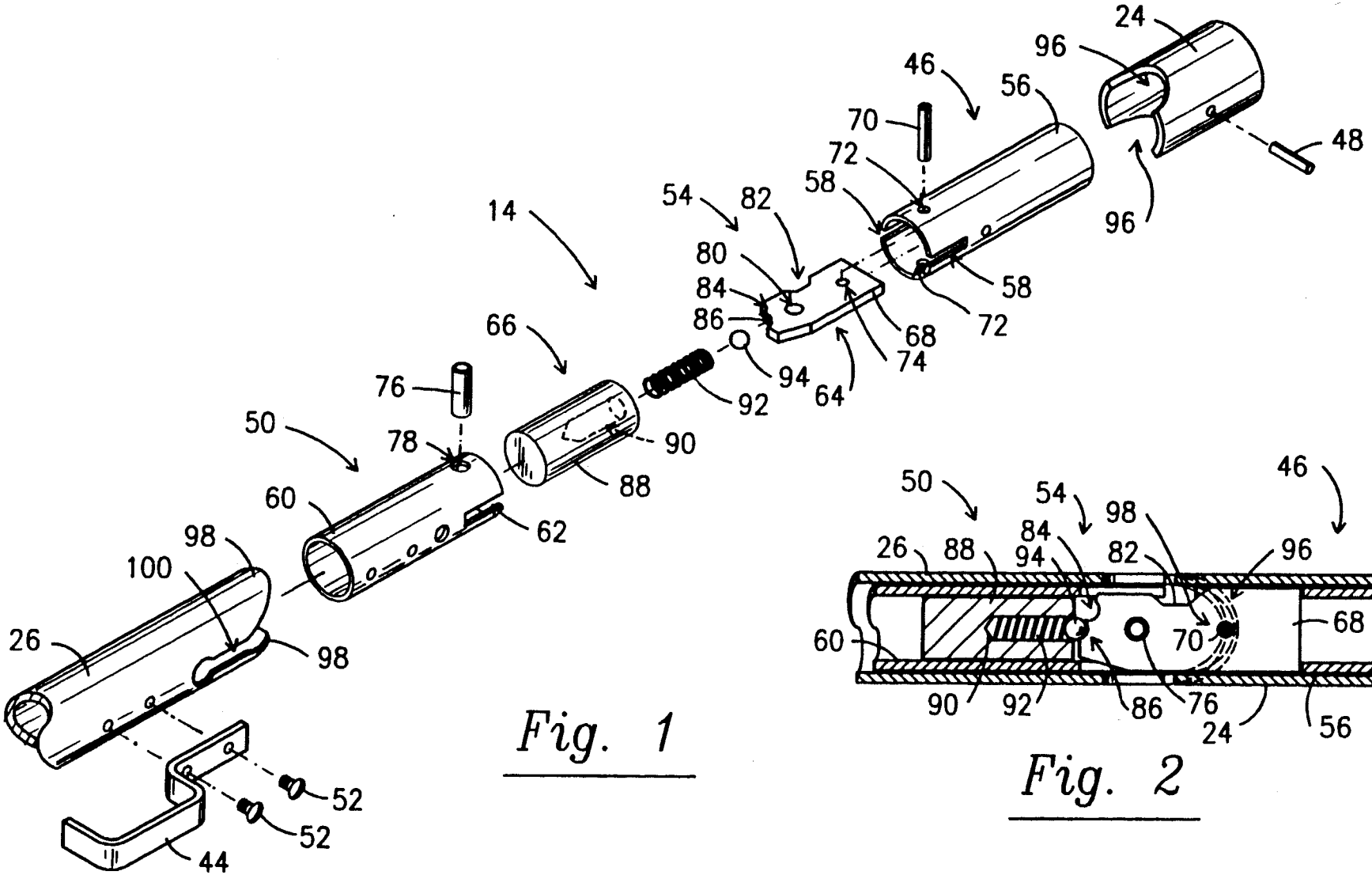
FIG. 1 is an exploded view of the switching mechanism of the present invention.
FIG. 2 is a detailed cross-sectional view of the switching mechanism shown in FIG. 1.

FIGS. 1, 2, 4 and 5 and FIGS. 3, 6 and 7 show alternate embodiments of the present invention comprising a switching mechanism for use with an overhead rail system for supporting and transporting products thereon.

As shown in FIGS. 4 through 7, the overhead rail system comprises an overhead support generally indicated as 10 to support a main rail track generally indicated as 12 and a branch rail track generally indicated as 14. The overhead support 10 comprises a substantially horizontal overhead member 16 suspended from the ceiling (not shown) or other such structure having a plurality of main rail track supports generally indicated as 18 extending downwardly therefrom to support the main rail track 12 and a plurality of branch rail track supports generally indicated as 20 extending downwardly therefrom to support the branch rail track 14. The main rail track 12 comprises a substantially horizontal main rail 22; while, the branch rail track 14 comprises an inclined branch rail 24 and an extension branch rail 26 movable between a first or upper substantially horizontal position (FIGS. 4 and 6) and a second or lower inclined position in substantially coaxial alignment with the inclined branch rail 24 (FIGS. 5 and 7) as described more fully hereinafter. A plurality of product support trolleys each generally indicated as 28 are suspended from the main rail track 12 and branch rail track 14. Each product support trolley 28 comprises a roller means generally indicated as 30 and a product support apparatus generally indicated as 32 configured to support garments or the like (not shown).

Figure 5:
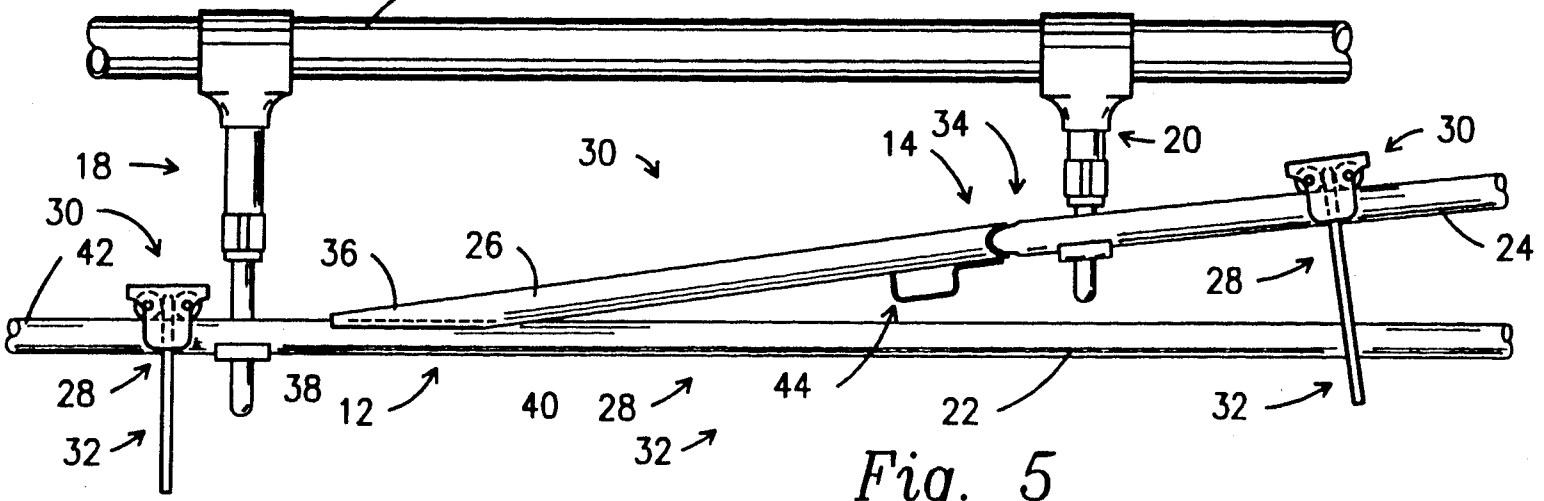
FIG. 5 is a side view of the switching mechanism shown in FIG. 1 in the second position.
Figure 7:
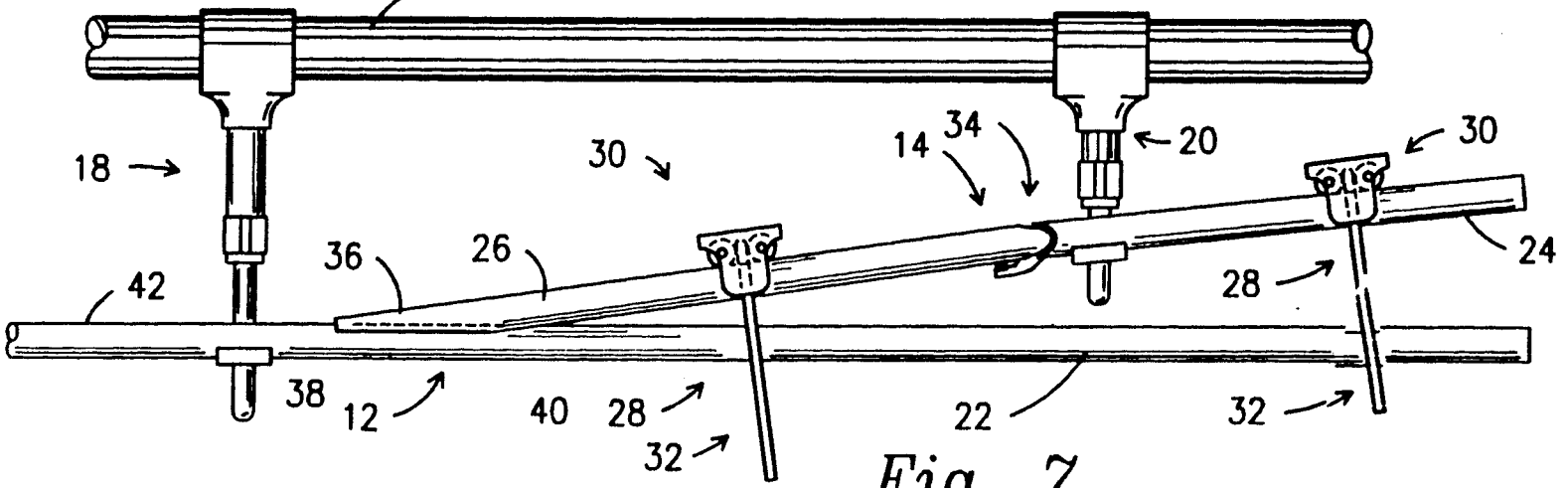
FIG. 7 is a side view of the switching mechanism shown in FIG. 3 in the second position.

The switching mechanism as described more fully hereinafter is configured to be operatively coupled to adjacent ends of joint 34 of the inclined branch rail 24 and extension branch rail 26 to permit selective movement of the extension branch rail 26 between the first or upper position and the second or lower position relative to the inclined branch rail 24. The outer end portion 36 of the extension branch rail 26 includes an inclined cutaway surface 38 on the lower side 40 thereof to engage the upper side 42 of the substantially horizontal main rail 22 when the extension branch rail 26 is in the second or lower position (FIGS. 5 and 7). In addition, the embodiment shown in FIGS. 1, 2, 4 and 5 includes a handle 44 affixed to the extension branch rail 26 adjacent the joint 34.

FIGS. 1 and 2 show a manually activated switching mechanism. Specifically, the manually activated switching mechanism comprises a first switching member generally indicated as 46 affixed to the inclined branch rail 24 by a connector pin 48 and a second switching member generally indicated as 50 affixed to the extension branch rail 26 by a pair of fasteners each indicated as 52 that also secure the handle 44 thereto coupled together by a branch rail positioning means generally indicated as 54.

As shown in FIGS. 1 and 2, the first switching member 46 comprises a first hollow substantially cylindrical switching element 56 partially disposed within the inclined branch rail 24 and including a first pair of slots each indicated as 58 to seat a portion of the branch rail positioning means 54 as described more fully hereinafter. The second switching member 50 comprises a second hollow substantially cylindrical switching element 60 partially disposed within the extension branch rail 26 and including a second pair of slots each indicated as 62 to receive a portion of the branch rail positioning means 54 as described more fully hereinafter. The branch rail positioning means 54 comprises an interconnecting switch element generally indicated as 64 and a bias means generally indicated as 66. The interconnecting switch element 64 comprises a substantially flat interconnecting member 68 affixed in the first pair of slots 58 of the first hollow substantially cylindrical switching element 56 by a connector pin 70 extending through apertures 72 and 74 and movably coupled within the second pair of slots 62 of the second hollow substantially cylindrical switching element 60 by a connector pin 76 extending through apertures 78 and 80. The substantially flat interconnecting member 68 includes a notch 82 formed on the mid portion of the upper edge thereof to permit relative movement of the extension branch rail 26 and second switching member 50 relative to the inclined branch rail 24 and first switching member 46, and a first and second bias seat indicated as 84 and 86 respectively formed on the outer end thereof. The bias means 66 comprises a bias housing 88 disposed within the second hollow substantially cylindrical element 60 including a bias recess 90 formed in the outer end thereof to operatively house a spring or bias 92 to selectively bias or position a substantially spherical element 94 in the first or second bias seat 84 or 86 as described more fully hereinafter. Adjacent ends of the inclined branch rail 24 and the extension branch rail 26 include concave recesses 96 and convex extensions 98 respectively such that the switching mechanism is substantially disposed therein; while, permitting relative movement therebetween.

In use, the extension branch rail 26 is normally held in the first position (FIG. 4) with the substantially spherical element 94 held seated in the first bias seat 84 by the spring or bias 92. In this configuration, product is moved along the main rail track 12. To permit feeding or movement of product from the branch rail track 14 to the main rail track 12, the extension branch rail 26 is moved from the position first (FIG. 4) to the second position (FIG. 5) by means of the handle 44 repositioning the substantially spherical element 94 from the first bias seat 84 to the second bias seat 86. The spring or bias 92 will maintain the extension branch rail 26 in the second position (FIG. 5) until manually returned to the first position (FIG. 4) moving the substantially spherical element 94 to the first bias seat 84. A slot 100 is formed in the extension rail branch 26 in registry with one of the slots 62.

Figure 3:
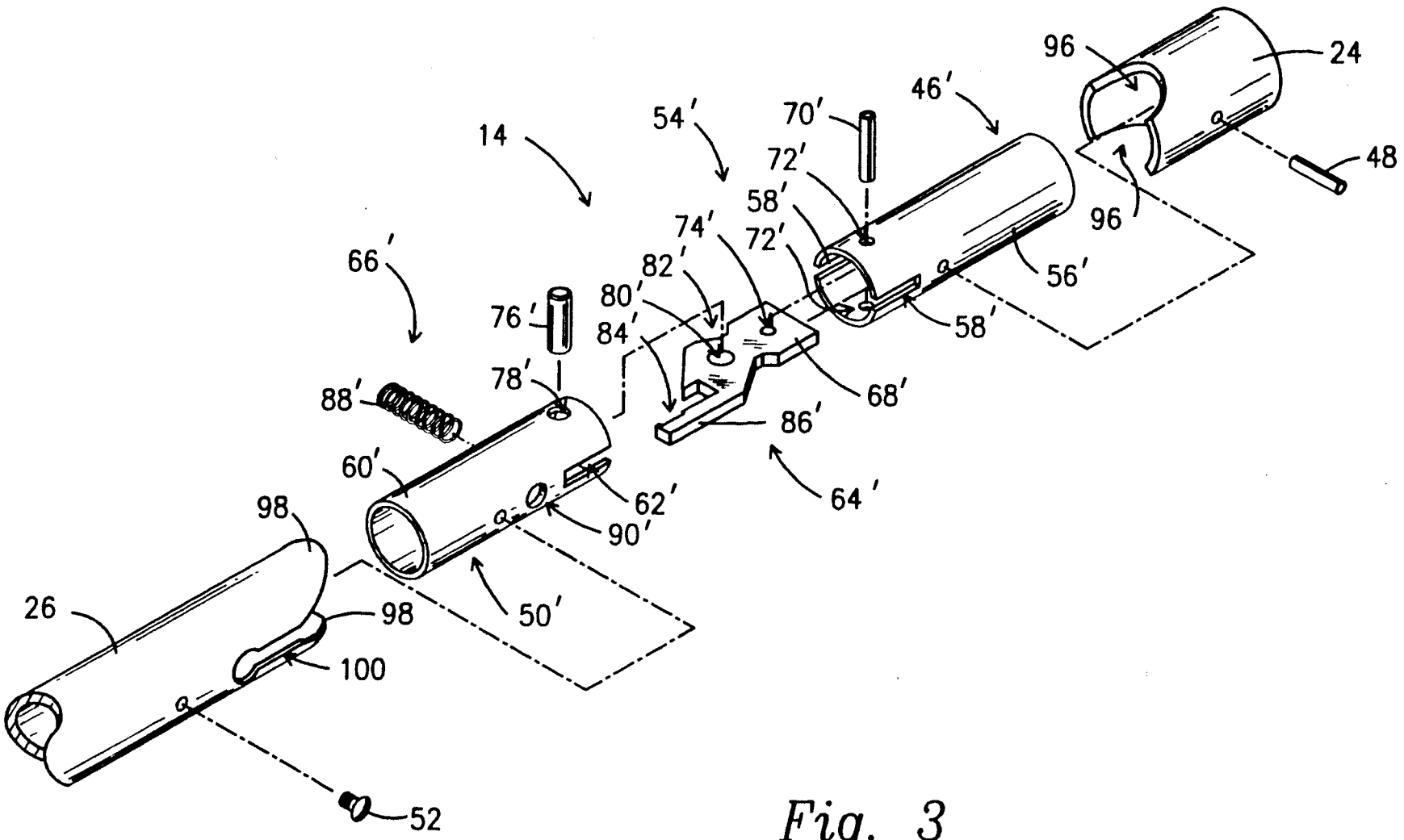
FIG. 3 is an exploded view of an alternate embodiment of the switching mechanism of the present invention.
Figure 4:
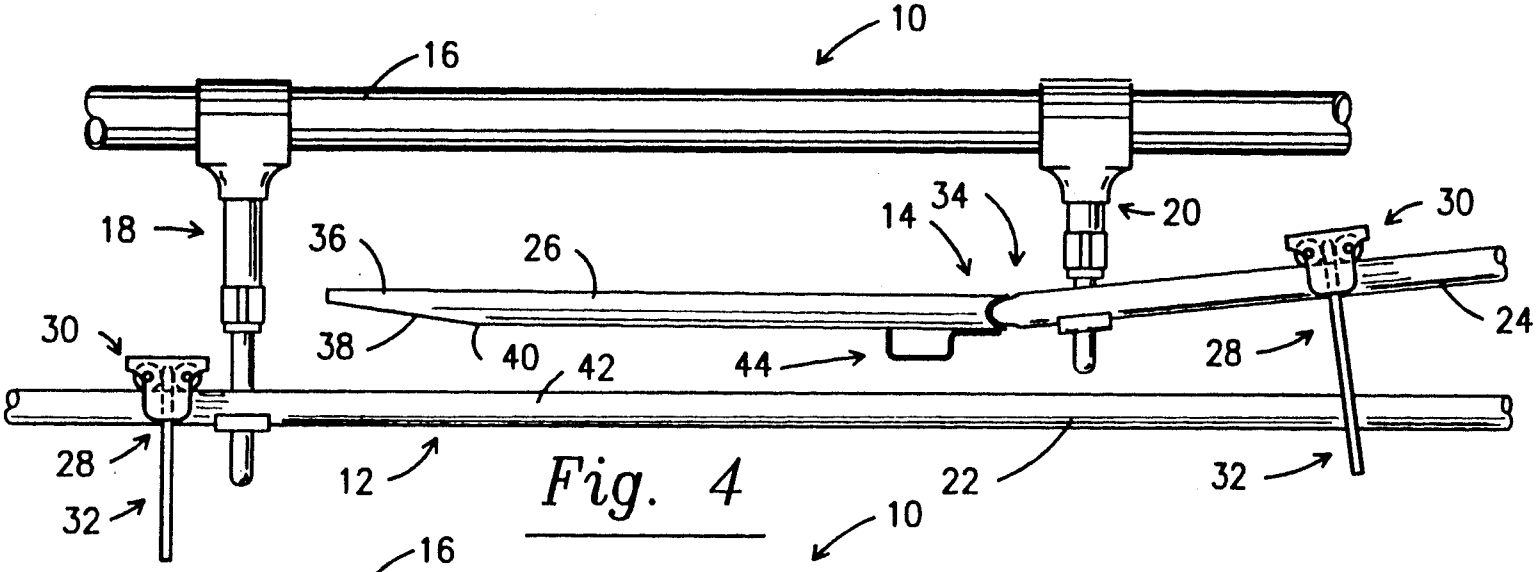
FIG. 4 is a side view of the switching mechanism shown in FIG. 1 in the first position.

FIG. 3 shows an automatic switching mechanism. Specifically, the automatic switching mechanism comprises a first switching member generally indicated as 46' affixed to the inclined branch rail 24 by a connector pin 48 and a second switching member generally indicated as 50' affixed to the extension branch rail 26 by a fastener 52 coupled together by a branch rail positioning means generally indicated as 54'.

Figure 6:
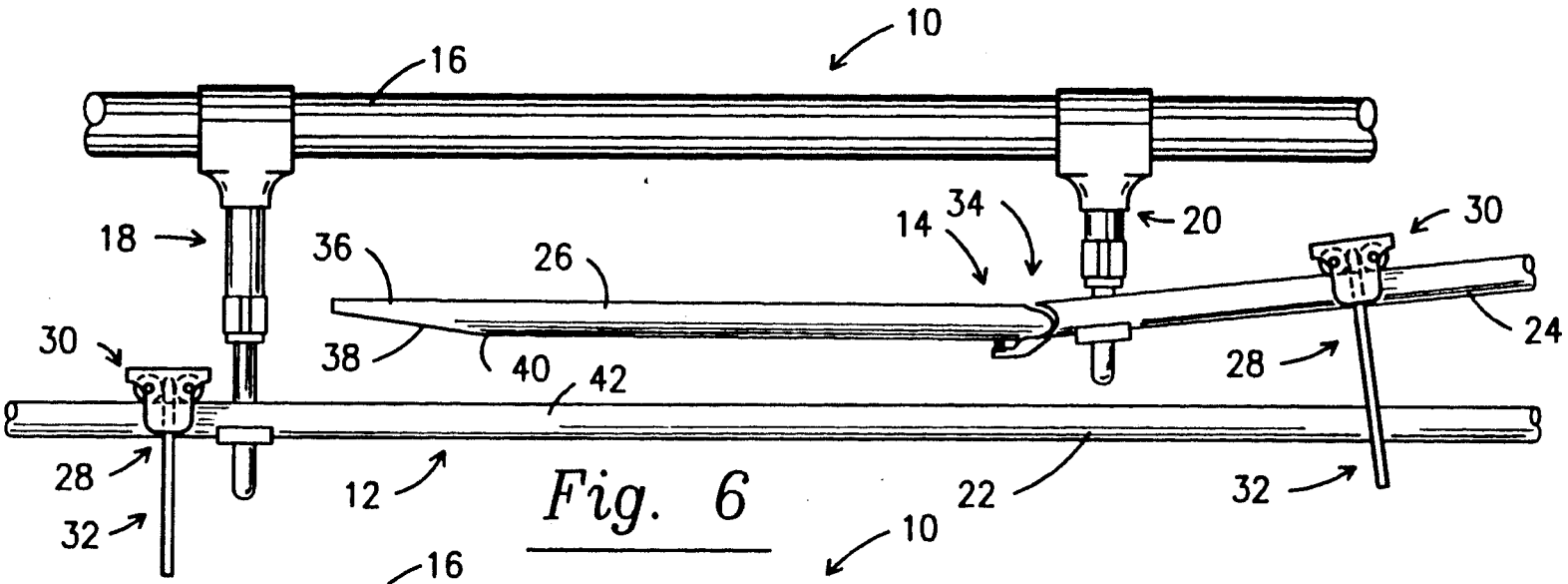
FIG. 6 is a side view of the switching mechanism shown in FIG. 3 in the first position.

As shown in FIG. 3, the first switching member 46' comprises a first hollow substantially cylindrical switching element 56' partially disposed within the inclined branch rail 24 and including a first pair of slots each indicated as 58' to seat a portion of the branch rail positioning means 54' as described more fully hereinafter. The second switching member 50' comprises a second hollow substantially cylindrical switching element 60' partially disposed within the extension branch rail 26 and including a second pair of slots each indicated as 62' to receive a portion of the branch rail positioning means 54' as described more fully hereinafter. The branch rail positioning means 54' comprises an interconnecting switch element generally indicated as 64' and a bias means generally indicated as 66'. The interconnecting switch element 64' comprises a substantially flat interconnecting member 68' affixed in the first pair of slots 58' of the first hollow substantially cylindrical switching element 56' by a connector pin 70' extending through apertures 72' and 74' and movably coupled within the second pair of slots 62' of the second hollow substantially cylindrical switching element 60' by a connecter pin 76' extending through apertures 78' and 80'. The substantially flat interconnecting member 68' includes a notch 82' formed on the mid portion of the upper edge thereof to permit relative movement of the extension branch rail 26 and second switching member 50' relative to the inclined branch rail 24 and first switching member 46', and a first bias seat 84' formed on an outer leg 86'. The bias means 66' comprises a spring or bias 88' disposed within the second hollow substantially cylindrical switching element 60' extending through bias aperture 90' to operatively seat in the first bias seat 84' to normally bias or position the second switching member 50' in the first position (FIG. 6). Adjacent ends of the inclined branch rail 24 and the extension branch rail 26 include concave recesses 96 and convex extensions 98 respectively such that the switching mechanism is substantially disposed therein; while, permitting relative movement therebetween. A slot 100 is formed in the extension rail branch 26 in registry with one of the slots 62'.

In use, the extension branch rail 26 is normally held in the first position (FIG. 6) with the spring or bias 88' held seated in the first bias seat 84'. In this configuration, product is moved along the main rail track 12. To permit feeding or movement of product from the branch rail track 14 to the main track 12, the extension branch rail 26 is moved from the first position (FIG. 6) to the second position (FIG. 7) under the weight of the product acting against the force of the spring or bias 88'. The extension branch rail 26 will remain in the second position (FIG. 7) until the product is no longer on the extension branch rail 26 returning to the first position (FIG. 6) under the force of the spring or bias 92'.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A switching mechanism for use with an overhead rail system including a main rail track and a branch rail track comprising an inclined branch rail and an extension branch rail to support and move product thereon, said switching mechanism comprises a first switching member including a first switching element partially disposed within the inclined branch rail and a second switching member including a second switching element partially disposed within the extension branch rail coupled together by a branch rail positioning means comprising an interconnecting switch element including a first and second bias seat formed on one end thereof and a bias means comprising a bias housing coupled to said second switching element including a bias recess formed in the outer end thereof to operatively house a bias to selectively bias a substantially spherical element in said first or second bias seat, said second switching element is selectively movable between a first and second position such that the product is transported on the main rail track when said second switching element is in said first position and the product is transported from the branch rail track to the main rail track when said second switching element is in said second position.

2. The switching mechanism of claim 1 wherein said interconnecting switch element comprises a substantially flat interconnecting member affixed to said first switching element and movably coupled to said second switching element.

3. The switching mechanism of claim 2 wherein said substantially flat interconnecting member includes a notch formed on the mid portion thereof to permit relative movement of the extension branch rail and second switching member relative to the inclined branch rail and said first switching member.

4. A switching mechanism for use with an overhead rail system including a main rail track and a branch rail track comprising an inclined branch rail and an extension branch rail to support and move product thereon, said switching mechanism comprises a first switching member including a first switching element partially disposed within the inclined branch rail and a second switching member including a second switching element partially disposed within the extension branch rail respectively coupled together by a branch rail positioning means comprising an interconnecting switch element comprising a substantially flat interconnecting member affixed to said first switching element and movably coupled to said second switching element and a bias means comprising a bias disposed within said second switching element extending through a bias aperture to operatively seat in said first bias seat to normally bias said second switching member in a first position, said substantially flat interconnecting member including a notch formed on the mid portion thereof to permit relative movement of the extension branch rail and said second switching member relative to the inclined branch rail and said first switching member and a first bias seat to receive said bias, said second switching element is selectively movable between a first and second position such that the product is transported on the main rail track when said second switching element is in said first position and the product is transported from the branch rail track to the main rail track when said second switching element is in said second position.

5. A switching mechanism for use with an overhead rail system including a main rail track and a branch rail track comprising an inclined branch rail and an extension branch rail to support and move product thereon, said switching mechanism comprises a first switching member including a first switching element disposed within the inclined branch rail and in axial alignment therewith and a second switching member including a second switching element disposed within the extension branch rail respectively coupled together by a branch rail positioning means comprising an interconnecting switch element and a bias means operatively disposed within said first and second switching member, said second switching element is selectively movable between a first and second position such that the product is transported on the main rail track when said second switching element is in said first position and the product is transported from the branch rail track to the main rail track when said second switching element is in said second position.

6. The switching mechanism of claim 5 wherein said interconnecting switch element comprises a substantially flat interconnecting member affixed to said first switching element and movably coupled to said second switching element.

7. The switching mechanism of claim 6 wherein said substantially flat interconnecting member includes a notch formed on the mid portion thereof to permit relative movement of the extension branch rail and said second switching member relative to the inclined branch rail and said first switching member.

8. The switching mechanism of claim 6 wherein said substantially flat interconnecting member includes a notch formed on the mid portion thereof to permit relative movement of the extension branch rail and second switching member relative to the inclined branch rail and first switching member and a first bias seat to receive a portion of said bias.

9. The switching mechanism of claim 8 wherein said bias means comprises a bias disposed within said switching element extending through a bias aperture to operatively seat in said first bias seat to normally bias said second switching member in said first position.

10. The switching mechanism of claim 5 further including a first and second bias seat formed on one end thereof.

11. The switching mechanism of claim 10 wherein said bias means further comprises a bias housing coupled to said second element including a bias recess formed in the outer end thereof to operatively house a bias to selectively bias a substantially spherical element in said first or second bias seat.

* * * * *